US012409366B2

(12) United States Patent
Burbary et al.

(10) Patent No.: US 12,409,366 B2
(45) Date of Patent: Sep. 9, 2025

(54) BIODEGRADABLE TENNIS BALL

(71) Applicants: Ryan Burbary, Centennial, CO (US); Adam Burbary, Centennial, CO (US); Carl David Bodam, Boulder, CO (US)

(72) Inventors: Ryan Burbary, Centennial, CO (US); Adam Burbary, Centennial, CO (US); Carl David Bodam, Boulder, CO (US)

(73) Assignee: Game-Set-Match, Inc., Centennial, CO (US)

( * ) Notice: Subject to any disclaimer, the term of this patent is extended or adjusted under 35 U.S.C. 154(b) by 121 days.

(21) Appl. No.: 18/318,352

(22) Filed: May 16, 2023

(65) Prior Publication Data

US 2023/0405409 A1 Dec. 21, 2023

Related U.S. Application Data

(60) Provisional application No. 63/364,929, filed on May 18, 2022.

(51) Int. Cl.
*A63B 39/00* (2006.01)

(52) U.S. Cl.
CPC ..... *A63B 39/00* (2013.01); *A63B 2039/006* (2013.01)

(58) Field of Classification Search
CPC ..... A63B 39/00; A63B 2039/006; A63B 2102/02; A63B 2209/18
See application file for complete search history.

(56) References Cited

U.S. PATENT DOCUMENTS

| | | | | |
|---|---|---|---|---|
| 2,896,949 | A * | 7/1959 | Christian | B29D 22/04 521/54 |
| 5,209,471 | A * | 5/1993 | Horiuchi | A63B 39/00 525/232 |
| 5,551,688 | A | 9/1996 | Miller | |
| 2009/0023525 | A1 | 1/2009 | Vleghert | |
| 2016/0375317 | A1 | 12/2016 | Connelly | |

(Continued)

FOREIGN PATENT DOCUMENTS

| | | | |
|---|---|---|---|
| GB | 598711 | A * | 2/1948 |
| JP | 2020196839 | A * | 12/2020 |

(Continued)

OTHER PUBLICATIONS

International Searching Authority, "International Search Report and Written Opinion," issued in connection with Internation Patent Application No. PCT/US2023/067116, dated Oct. 19, 2023 (14 pages). (Year: 2023).*

(Continued)

*Primary Examiner* — Steven B Wong
(74) *Attorney, Agent, or Firm* — Holland & Hart LLP

(57) ABSTRACT

Biodegradable tennis balls are described. A biodegradable tennis ball includes a core forming a hollow interior chamber, the core made of a blend of a rubber based material, a first petroleum based material, and a first biodegradable additive. The biodegradable tennis ball also includes a felt layer overlaying a surface of the core, the felt layer made of a second blend of a second petroleum based material and a second biodegradable additive. In some cases, the biodegradable tennis ball may include an adhesive layer adhering the felt layer to the core. In some cases, the felt layer may further include wool.

9 Claims, 2 Drawing Sheets

100

(56) References Cited

U.S. PATENT DOCUMENTS

| | | | | |
|---|---|---|---|---|
| 2020/0190289 | A1* | 6/2020 | Hyodo | A63B 39/02 |
| 2022/0040537 | A1 | 2/2022 | Simonutti et al. | |
| 2022/0288813 | A1* | 9/2022 | Senior | B07B 1/06 |
| 2023/0285810 | A1* | 9/2023 | Burbary | A63B 51/02 |
| 2023/0356383 | A1* | 11/2023 | Burbary | A63B 53/14 |
| 2024/0216762 | A1* | 7/2024 | Boyle | D01F 6/60 |

FOREIGN PATENT DOCUMENTS

| | | | | |
|---|---|---|---|---|
| WO | WO-2010012736 | A1 * | 2/2010 | A63B 39/00 |
| WO | WO-2021259884 | A1 * | 12/2021 | A63B 39/00 |
| WO | WO-2022250535 | A1 * | 12/2022 | |

OTHER PUBLICATIONS

Ingevity, "Rosin", dated Jan. 25, 2022, retrieved from <https://web.archive.org/web/20220125172527/https://www.ingevity.com/uploads/page-pdfs/Refinery-Rosin.pdf>, retrieved on Feb. 3, 2025. (Year: 2022).*

Ingevity, "Rosin", Sep. 27, 2023, retrieved from https://www.ingevity.com/uploads/page-pdfs/Refinery-Rosin.pdf.

* cited by examiner

BIODEGRADABLE TENNIS BALL

CROSS REFERENCES

The present Application for Patent claims priority to U.S. Provisional Patent Application No. 63/364,929 by Bodam et al., entitled "BIODEGRADABLE TENNIS BALL," filed May 18, 2022, which is expressly incorporated by reference herein.

FIELD OF TECHNOLOGY

The present disclosure relates generally to sports balls including tennis balls.

BACKGROUND

Sports balls, such as golf balls, tennis balls, or inflatable balls such as soccer balls, volleyballs, basketballs, footballs, playground balls, etc., may be made of synthetic materials, such as petroleum based materials. For example, tennis balls may include a core forming a hollow interior chamber and a felt material adhered over the core material. In some tennis balls, the core may be made of a mixture of rubber and synthetic material, such as petroleum based material. In some tennis balls, the felt material may be made of a synthetic material, such as a petroleum based material, or a mixture of wool (e.g., sheep's wool) and a synthetic material. Synthetic, petroleum based materials in the core and felt of a tennis ball may generate waste in the form of plastic, which may be non-biodegradable. Similarly, other petroleum based materials in other sports balls may generate waste in the form of plastic, which may be non-biodegradable.

SUMMARY

The systems, methods and devices of this disclosure each have several innovative aspects, no single one of which is solely responsible for the desirable attributes disclosed herein.

The described techniques relate to improved devices, apparatuses, methods, and systems, that support biodegradable tennis balls, among other examples.

A biodegradable tennis ball is described. The biodegradable tennis ball may include a core forming a hollow interior chamber, the core including a first blend of a rubber based material, a first petroleum based material, and a first biodegradable additive; and a felt layer overlaying a surface of the core, the felt layer including a second blend of a second petroleum based material and a second biodegradable additive.

In some examples of the biodegradable tennis ball described herein, the first biodegradable additive may be between 0.2 percent and 4 percent of the core by weight.

In some examples of the biodegradable tennis ball described herein, the second biodegradable additive may be between 0.2 percent and 4 percent of the felt layer by weight.

In some examples of the biodegradable tennis ball described herein, the first biodegradable additive may be a same material type as the second biodegradable additive.

In some examples of the biodegradable tennis ball described herein, the hollow interior chamber has an interior pressure that is greater than atmospheric pressure.

In some examples of the biodegradable tennis ball described herein, the first petroleum based material may be one of nylon, polyester, or polyurethane.

In some examples of the biodegradable tennis ball described herein, the second petroleum based material may be nylon.

In some examples of the biodegradable tennis ball described herein, the second blend further includes at least one color additive.

Some examples of the biodegradable tennis ball described herein further include an adhesive adhering the felt layer to the core.

In some examples of the biodegradable tennis ball described herein, the second blend further includes wool.

A method for manufacturing a tennis ball is described. The method may include forming, in a pressurized environment, a core forming a hollow interior chamber, the core including a first blend of a rubber based material, a first petroleum based material, and a first biodegradable additive; and adhering a felt layer to an outer surface of the core via application of an adhesive, the felt layer comprising a second blend of a second petroleum based material and a second biodegradable additive.

In some examples of the method described herein, the first biodegradable additive may be between 0.2 percent and 4 percent of the core by weight.

In some examples of the method described herein, the second biodegradable additive may be between 0.2 percent and 4 percent of the felt layer by weight.

In some examples of the method described herein, the first biodegradable additive may be a same material type as the second biodegradable additive.

In some examples of the method described herein, the hollow interior chamber has an interior pressure that is greater than atmospheric pressure.

In some examples of the method described herein, the first petroleum based material may be one of nylon, polyester, or polyurethane.

In some examples of the method described herein, the second petroleum based material may be nylon.

In some examples of the method described herein, the second blend further includes at least one color additive.

In some examples of the method described herein, the second blend further includes wool.

In some examples of the method described herein, forming the core may further include operations, features, means, or instructions for blending the rubber based material, the first petroleum based material, and the first biodegradable additive.

In some examples of the method described herein, forming the felt layer may further include operations, features, means, or instructions for forming the felt layer via blending the second petroleum based material and the second biodegradable additive.

DETAILED DESCRIPTION

Figure 1:
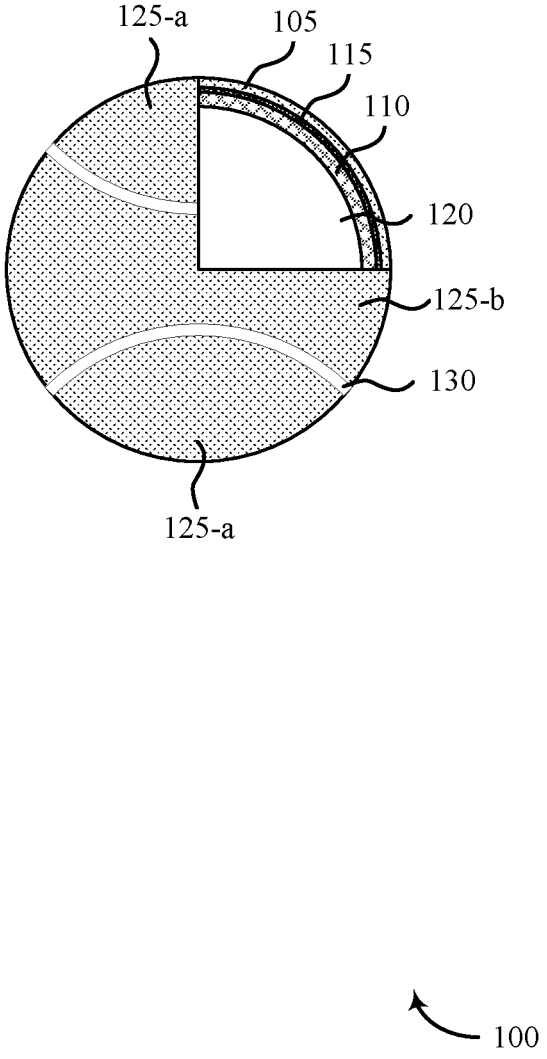
FIG. 1 illustrates a biodegradable tennis ball including a cut out view of the interior of the biodegradable tennis ball in accordance with aspects of the present disclosure.

Sports balls, such as golf balls, tennis balls, or inflatable balls such as soccer balls, volleyballs, basketballs, footballs, playground balls, etc., may be made of synthetic materials, such as petroleum based materials. For example, tennis balls may include a spherical core forming a hollow interior chamber and a felt material adhered over the core material. In some tennis balls, the core may be made of a mixture of rubber and synthetic material, such as petroleum based material. In some tennis balls, the core may not be hollow, but may be filled with one or more materials that provide a pressurized feel to the ball (e.g., enabling "bounce" for the tennis ball). In some tennis balls, the felt material may be made of a synthetic material, such as a petroleum based material, or a blend of wool (e.g., sheep's wool) and a synthetic material.

A tennis ball may be manufactured by first mixing and heating a blend of rubber and a synthetic petroleum based material and then forming the mixture into a hollow spherical core for the tennis ball. In some cases, the hollow spherical core may be formed by forming two hollow semi-spheres and joining (e.g., via an adhesive such as a glue), the two semi-spheres together to form a hollow spherical core. In some cases, the core may be airtight and formed in pressurized environment (e.g., the pressurized environment may have a pressure of 12 or more pounds per square inch ("psi")), and accordingly the hollow interior chamber of the core of the tennis ball may have a pressure above atmospheric pressure (e.g., 12 or more psi). The pressurized core may provide more "bounce" to the tennis ball and increase playability. As described herein, in some tennis balls, the core may not be hollow, but may be filled with one or more materials that provide a pressurized feel to the ball (e.g., enabling "bounce" for the tennis ball). For example a matrix of materials in the core may push against the exterior of the tennis ball, providing pressure against the exterior of the tennis ball and thereby providing "bounce" to the tennis ball. Once the spherical core of a tennis ball is formed, an adhesive layer (e.g., a glue material) may be applied to the exterior surface of the core of the tennis ball. A felt layer may be applied over the adhesive layer. In some cases, the felt layer may be made of a synthetic petroleum based material (e.g., nylon). In some cases, a felt layer for the tennis ball may be formed by blending wool with a petroleum based material. For example, the felt layer may be formed of wool fibers and synthetic petroleum based fibers. In some cases, two "dogbone" shaped felt layers may be applied over the adhesive layer in an interlocking manner. Accordingly, the adhesive layer may form a seam between the two "dogbone" shaped adhesive layers overlaying the hollow core.

The wool in the felt material and the rubber in the core may naturally biodegrade. Synthetic, petroleum based materials in the core and felt of a tennis ball may generate waste in the form of plastic, which may be nonrecyclable or may have a long degradation lifetime (e.g., hundreds or thousands of years). Similarly, the petroleum based materials in other sports balls, such as golf balls or inflatable balls such as soccer balls, volleyballs, basketballs, footballs, playground balls, may have a long degradation lifetime. For example, golf balls may include petroleum based materials in the outer shell and/or the core, and inflatable balls may include petroleum based materials in the inflatable shell of the balls. With regard to tennis balls. over time, and with use, the pressure of the hollow interior core of a tennis ball may decrease (e.g., the hollow interior core of a tennis ball may drift towards atmospheric pressure), decreasing the bounce of the tennis ball and decreasing the playability of the tennis ball. Further, over time and with use, the felt layer may wear down. For example, over time and with use, material (e.g., fibers) of the felt layer may be lost. As another example, over time, the ability of the fibers of the felt layer to snap back or revert to the original position of the fibers may decrease. The ability of the fibers of the felt layer of the tennis ball to snap back or revert to the original position of the fibers may affect ball control and spin rates during play, and accordingly a decrease in the ability of the fibers of the felt layer of the tennis ball to snap back or revert to the original position of the fibers may decrease playability of a tennis ball. When a tennis ball degrades (e.g., due to loss of interior pressure or wear down of the felt layer), the tennis ball is likely to be discarded and therefore generate plastic waste. The faster tennis ball degrade, the more waste may be generated by discarded tennis balls.

Some plastics (e.g., petroleum based materials) may be biodegradable. For example, biodegradable plastic may be made of bioplastics, where the components are derived from renewable raw materials, or plastics made from petrochemicals with biodegradable additives that enhance the biodegradation of the polymers by allowing microorganisms to utilize the carbon within the polymer chain as a source of energy. Examples of biodegradable additives include starches, certain microbial strains, and pro oxidant additives (e.g., iron, manganese, and cobalt). However, current tennis balls do not include biodegradable additives and therefore generate plastic waste once discarded. In some cases, tennis balls may frequently be replaced (e.g., due to degradation caused by use). For example, multiple tennis balls may be used and discarded during a match. Accordingly, non-biodegradable tennis balls may contribute significant plastic waste.

In accordance with aspects of the present disclosure, synthetic materials in tennis balls may be manufactured using a petroleum based material and a biodegradable additive blended with the petroleum based material. The addition of the biodegradable additive may result in the synthetic materials in a tennis ball having a significantly shorter degradation lifetime relative to traditional synthetic materials in tennis balls. In some examples, the biodegradable petroleum based materials in a tennis ball may biodegrade in approximately 3 to 5 years. The addition of a biodegradable additive may not change the manufacturing process of tennis balls aside from the addition of the biodegradable additive during the mixing process for the core and the felt layer. Additionally, addition of biodegradable additives to petroleum based materials in tennis balls may have other unexpected advantages beyond biodegradability, not limited to greater durability for the tennis balls. A biodegradable additive may similarly be blended with the petroleum based material for other types of sports balls such as golf balls or inflatable balls such as soccer balls, volleyballs, basketballs, footballs, playground balls, in order to increase the biodegradability of the balls and reduce waste.

Aspects of the disclosure are initially described in the context of biodegradable tennis balls. Aspects of the disclosure are further illustrated by and described with reference to flowcharts relating to manufacturing biodegradable tennis balls.

This description provides examples, and is not intended to limit the scope, applicability or configuration of the principles described herein. Rather, the ensuing description will provide those skilled in the art with an enabling description for implementing various aspects of the principles described herein. As can be understood by one skilled in the art, various changes may be made in the function and arrangement of elements without departing from the application.

FIG. 1 illustrates an example biodegradable tennis ball 100 including a cut out view of the interior of the biodegradable tennis ball 100 in accordance with aspects of the present disclosure. The example biodegradable tennis ball 100 includes a core 110 and a felt layer 105 overlaying a surface of the core 110. The felt layer 105 may be adhered to the core 110 via an adhesive layer 115. The core 110 may form a hollow interior chamber 120.

The core 110 may be spherical and may include a first blend of a rubber based material, a first petroleum based material, and a first biodegradable additive. In some cases, the first biodegradable additive may be between 0.2 percent and 4 percent of the core 110 by weight. In some cases, the first petroleum based material may be one of nylon, polyester, or polyurethane.

The felt layer 105 may include a second blend of a second petroleum based material and a second biodegradable additive. In some cases, the felt layer 105 may further include wool. In some cases, second petroleum based material may be nylon. In some cases the second blend may include at least one color additive (e.g., yellow). In some cases, the felt layer 105 may be formed into two dogbone shaped layers (e.g., a first layer 125-*a* and a second layer 125-*b*) which may overlay the core 110. The first layer 125-*a* and the second layer 125-*b* may meet at a seam 130 (which may be formed of an adhesive material). In some cases, the second biodegradable additive may be between 0.2 percent and 4 percent of the felt layer by weight. In some cases, the first biodegradable additive may be a same material type as the second biodegradable additive.

In some cases, the hollow interior chamber 120 may have interior pressure that is greater than atmospheric pressure. For example, the core 110 may be airtight and formed in pressurized environment (e.g., the pressurized environment may have a pressure of 12 or more psi, and accordingly the hollow interior chamber 120 of the core 110 may have a pressure above atmospheric pressure (e.g., 12 or more psi). The pressurized hollow interior chamber 120 may provide more "bounce" to the tennis ball and increase playability. The addition of the biodegradable additive to the core 110 has been shown to maintain the interior pressure of the hollow interior chamber 120 better as compared to tennis balls identical in all aspects except for the biodegradable additive. Accordingly, the addition of the biodegradable additive to the core 110 has been shown to increase the durability of the biodegradable tennis ball 100 as compared to traditional tennis balls. In some cases, the interior chamber 120 may not be hollow but may be filled with materials (e.g., a matrix of materials) that provide a pressurized feel to the ball (e.g., enabling "bounce" for the tennis ball). The materials in the interior chamber may be made of a petroleum based material blended with a biodegradable additive.

The addition of the biodegradable material to the material of the felt layer 105 has been shown to increase the durability of the felt layer 105 as compared to tennis balls identical in all aspects except for the biodegradable additive. Specifically, the addition of the biodegradable layer has been shown to decrease material loss in the felt layer 105 with use of the biodegradable tennis ball 100. Further, the addition of the biodegradable layer has prolonged the ability of the fibers of the felt layer 105 to snap back or revert to the original position of the fibers. Accordingly, the addition of the biodegradable additive to the felt layer 105 has been shown to increase the durability of the biodegradable tennis ball 100 as compared to traditional tennis balls.

Figure 2:
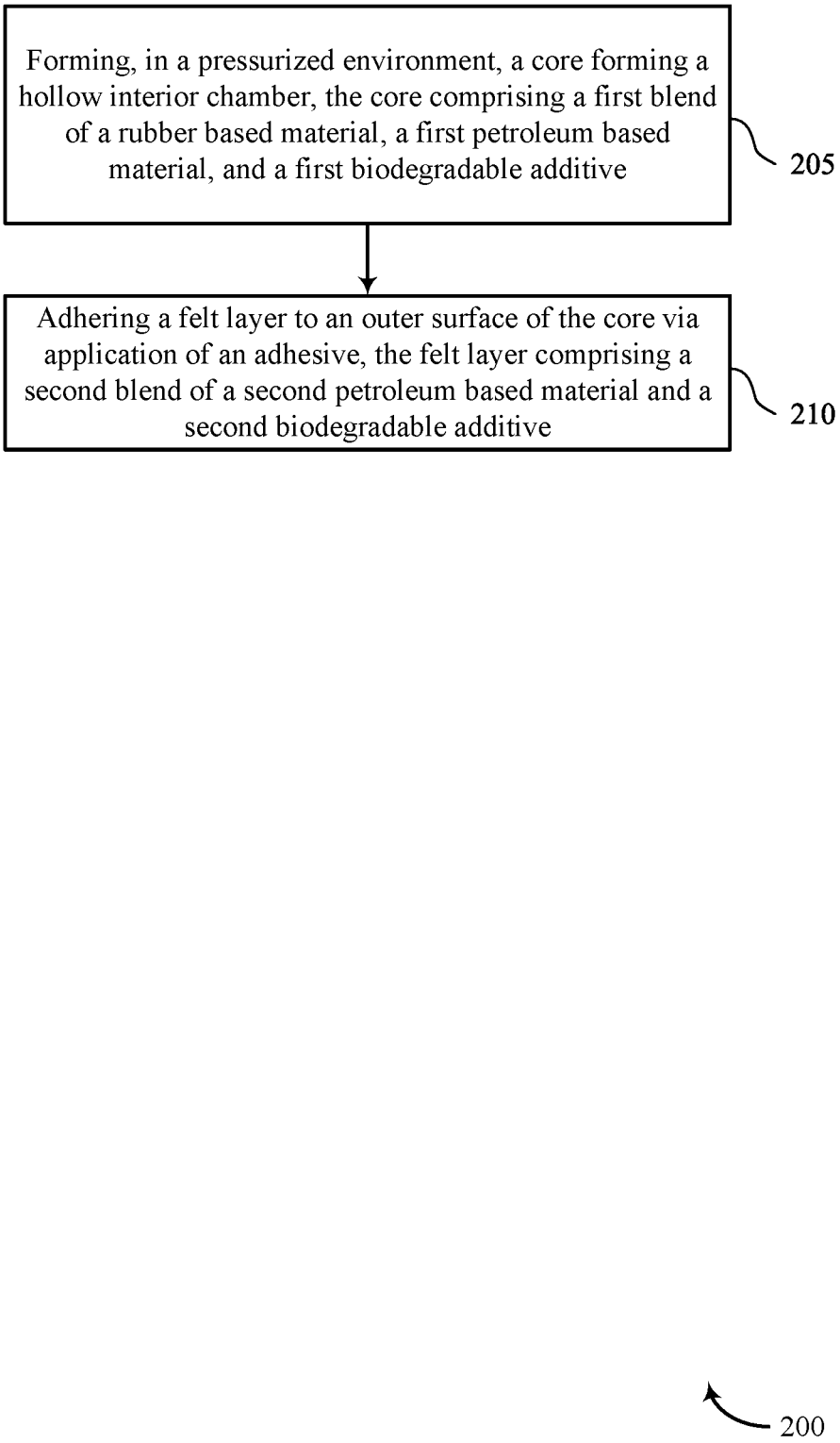
FIG. 2 illustrates a method that supports manufacturing a biodegradable tennis ball in accordance with aspects of the present disclosure.

FIG. 2 shows a flowchart illustrating a method 200 that supports a biodegradable tennis ball in accordance with aspects of the present disclosure. The operations of the method 200 may be implemented by a tennis ball manufacturing system, as described herein.

At 205, the method may include forming, in a pressurized environment, a core forming a hollow interior chamber, the core including a first blend of a rubber based material, a first petroleum based material, and a first biodegradable additive. In some cases, the first biodegradable additive may be between 0.2 percent and 4 percent of the core by weight. In some cases, the first petroleum based material may be one of nylon, polyester, or polyurethane. In some cases, forming the core includes blending the rubber based material, the first petroleum based material, and the first biodegradable additive. In some cases, the hollow interior chamber has an interior pressure that is greater than atmospheric pressure. As described herein, in some tennis balls, the core may not be hollow, but may be filled with one or more materials that provide a pressurized feel to the ball (e.g., enabling "bounce" for the tennis ball). For example a matrix of materials in the core may push against the exterior of the tennis ball, providing pressure against the exterior of the tennis ball and thereby providing "bounce" to the tennis ball. In such cases, the manufacturing process may involve blending the synthetic petroleum based material with a biodegradable additive and placing the inner material in the core prior to sealing the core of the tennis ball. In some cases, the biodegradable additive may be between 0.2 percent and 4 percent of the inner material by weight.

At 210, the method may include adhering a felt layer to an outer surface of the core via application of an adhesive, the felt layer including a second blend of a second petroleum based material and a second biodegradable additive. In some cases, the second biodegradable additive comprises between 0.2 percent and 4 percent of the felt layer by weight. In some cases, the first biodegradable additive may be a same material type as the second biodegradable additive. In some cases, second petroleum based material may be nylon. In some cases, the second blend may include at least one color additive. In some cases, the second blend may include wool.

In some cases, the method may further include forming the felt layer via blending the second petroleum based material and the second biodegradable additive.

The description set forth herein, in connection with the appended drawings, describes example configurations and does not represent all the examples that may be implemented or that are within the scope of the claims. The detailed description includes specific details for the purpose of providing an understanding of the described techniques. These techniques, however, may be practiced without these specific details.

In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein, but is to be accorded the broadest scope consistent with the principles and novel features disclosed herein.

What is claimed is:

1. A biodegradable tennis ball comprising:

a core forming a hollow interior chamber, the core comprising a first blend of a rubber based material, a first petroleum based material, and a first biodegradable additive;

a felt layer overlaying a surface of the core, the felt layer comprising a second blend of a second petroleum based material and a second biodegradable additive; and an adhesive adhering the felt layer to the core, wherein the biodegradable tennis ball is biodegradable based on blending of the first petroleum based material with the first biodegradable additive and based on blending of the second petroleum based material with the second biodegradable additive.

2. The biodegradable tennis ball of claim 1, wherein the first biodegradable additive comprises between 0.2 percent and 4 percent of the core by weight.

3. The biodegradable tennis ball of claim 1, wherein the second biodegradable additive comprises between 0.2 percent and 4 percent of the felt layer by weight.

4. The biodegradable tennis ball of claim 1, wherein the first biodegradable additive comprises a same material type as the second biodegradable additive.

5. The biodegradable tennis ball of claim 1, wherein the hollow interior chamber has an interior pressure that is greater than atmospheric pressure.

6. The biodegradable tennis ball of claim 1, wherein the first petroleum based material comprises one of nylon, polyester, or polyurethane.

7. The biodegradable tennis ball of claim 1, wherein the second petroleum based material comprises nylon.

8. The biodegradable tennis ball of claim 1, wherein the second blend further comprises at least one color additive.

9. The biodegradable tennis ball of claim 1, wherein the second blend further comprises wool.

* * * * *